US009429869B1

(12) United States Patent
Tauchi

(10) Patent No.: US 9,429,869 B1
(45) Date of Patent: Aug. 30, 2016

(54) DEVELOPING DEVICE, AND IMAGE FORMING APPARATUS INCLUDING DEVELOPING DEVICE

(71) Applicant: KYOCERA Document Solutions Inc., Osaka-shi, Osaka (JP)

(72) Inventor: Yasuhiro Tauchi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 15/046,370

(22) Filed: Feb. 17, 2016

(30) Foreign Application Priority Data

Feb. 20, 2015 (JP) ..... 2015-032052

(51) Int. Cl.
*G03G 15/09* (2006.01)
*G03G 15/08* (2006.01)

(52) U.S. Cl.
CPC ..... *G03G 15/0812* (2013.01); *G03G 15/09* (2013.01)

(58) Field of Classification Search
USPC ..... 399/119, 120, 252, 265–268, 274–277
See application file for complete search history.

(56) References Cited

U.S. PATENT DOCUMENTS 4,887,131 A * 12/1989 Kinoshita ..... G03G 15/09 399/275
5,129,357 A * 7/1992 Yamaji ..... G03G 15/0921 399/277

FOREIGN PATENT DOCUMENTS

JP 2009258276 A 11/2009

* cited by examiner

*Primary Examiner* — Hoan Tran
(74) *Attorney, Agent, or Firm* — Alleman Hall McCoy Russell & Tuttle LLP

(57) ABSTRACT

In a developing device, a sheet member is provided via a gap at a second specific position in a specific region between a position on a downstream side in a first rotation direction relative to a first specific position, and a high-magnetic-force position at which an intensity of a magnetic force is the highest in a second region, on the outer circumferential surface of a developer carrying body. The sheet member limits a layer thickness of a two-component developer carried on the developer carrying body rotating in a second rotation direction. The sheet member is able to elastically deform in accordance with application of a pressing force equal to or greater than a tolerable value in the first rotation direction or the second rotation direction.

9 Claims, 11 Drawing Sheets

DEVELOPING DEVICE, AND IMAGE FORMING APPARATUS INCLUDING DEVELOPING DEVICE

INCORPORATION BY REFERENCE

This application is based upon and claims the benefit of priority from the corresponding Japanese Patent Application No. 2015-032052 filed on Feb. 20, 2015, the entire contents of which are incorporated herein by reference.

BACKGROUND

The present disclosure relates to a developing device which develops an electrostatic latent image by electrophotography, and an image forming apparatus including the developing device.

Generally, in a developing device provided in an image forming apparatus such as a multifunction peripheral, for example, the layer thickness of developer formed on the surface of a developer carrying body is limited by a layer thickness limiting member. At this time, scattered toner is accumulated on the surface of the layer thickness limiting member. When the accumulated toner increases, the accumulated toner transfers from the layer thickness limiting member to a photosensitive body, whereby the image quality might be adversely affected.

In an image forming apparatus using a two-component developer, carrier contained in the two-component developer forms a magnetic brush on the surface of the developer carrying body. In the image forming apparatus, it is known that the developer carrying body is rotated in a direction opposite to a rotation direction in a developing process, to scrape the accumulated toner by the magnetic brush.

SUMMARY

A developing device according to one aspect of the present disclosure includes a developer reservoir, a developer carrying body, a magnetic pole member, a layer thickness limiting member, and a sheet member. In the developer reservoir, a two-component developer is stored. The developer carrying body is supported so as to be rotatable in a first rotation direction and a second rotation direction, and is configured to rotate in the first rotation direction, thereby carrying the two-component developer stored in the developer reservoir on an outer circumferential surface of the developer carrying body and feeding, in a first region on the outer circumferential surface, toner contained in the two-component developer to a toner carrying body at a next stage. The magnetic pole member is configured to generate a magnetic force in a direction to separate the two-component developer from the developer carrying body, in a second region on a downstream side in the first rotation direction relative to the first region on the outer circumferential surface of the developer carrying body. The layer thickness limiting member is provided via a gap at a first specific position on an upstream side in the first rotation direction relative to the first region on the outer circumferential surface of the developer carrying body, and is configured to limit a layer thickness of the two-component developer carried on the developer carrying body rotating in the first rotation direction. The sheet member is provided via a gap at a second specific position in a specific region between a position on a downstream side in the first rotation direction relative to the first specific position, and a high-magnetic-force position at which an intensity of the magnetic force is the highest in the second region, on the outer circumferential surface of the developer carrying body. The sheet member is configured to limit a layer thickness of the two-component developer carried on the developer carrying body rotating in the second rotation direction. The sheet member is able to elastically deform in accordance with application of a pressing force equal to or greater than a tolerable value in the first rotation direction or the second rotation direction.

An image forming apparatus according to another aspect of the present disclosure includes a photosensitive body and a developing device. The photosensitive body allows an electrostatic latent image to be formed on a surface thereof. The developing device is configured to feed the toner to the photosensitive body, thereby developing the electrostatic latent image into a toner image.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
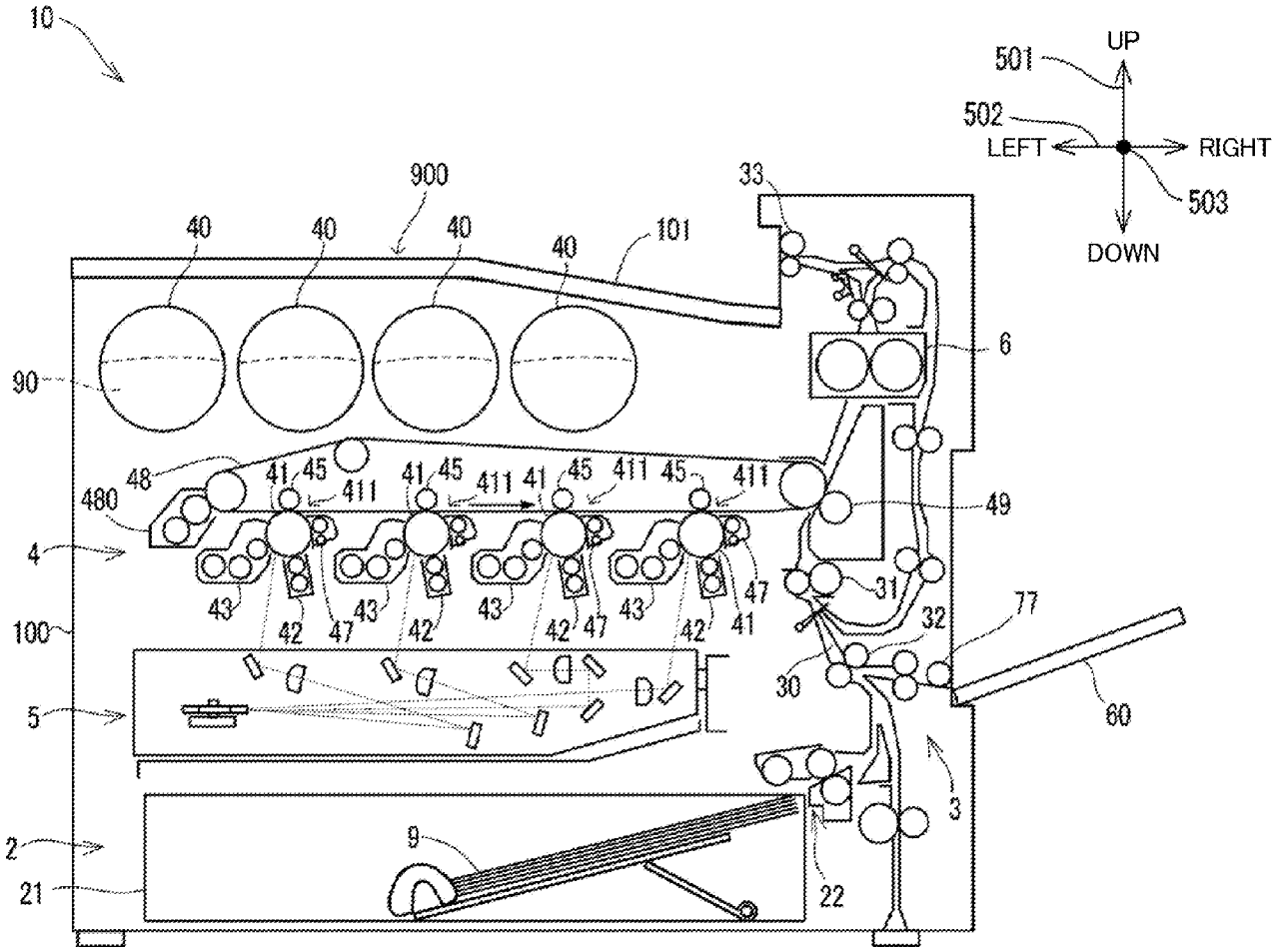
FIG. 1 is a schematic diagram showing the configuration of an image forming apparatus according to a first embodiment of the present disclosure.

Hereinafter, embodiments of the present disclosure will be described with reference to the accompanying drawings. The following embodiments are examples in which the present disclosure is embodied, and are not intended to limit the technical scope of the present disclosure.

First, with reference to FIGS. 1 to 3, the configuration of an image forming apparatus 10 according to a first embodiment of the present disclosure will be described. In the following description, an up-down direction 501, a right-left direction 502, and a front-rear direction 503 defined in FIG. 1 may be used.

The image forming apparatus 10 is an image forming apparatus of an electrophotography type. As shown in FIG. 1, the image forming apparatus 10 includes, in a housing 100, a sheet feed portion 2, a sheet conveyance portion 3, an image forming portion 4, a laser scanning portion 5, a fixing portion 6, a container installation portion 900, and the like.

The image forming apparatus 10 shown in FIG. 1 is a color printer, and is communicably connected to another communication device. The other communication device is, for example, a personal computer, and transmits job data indicating an image formation job to the image forming apparatus 10, thereby requesting the image forming apparatus 10 to execute the image formation job. Based on the job data received from the other communication device, the image forming apparatus 10 executes the image formation job requested by the other communication device. The job data includes image data of an image to be formed on a recording sheet 9, size information about the recording sheet 9, or the like.

The image forming apparatus 10 is a tandem-type image forming apparatus. The image forming portion 4 includes an intermediate transfer belt 48, a cleaning device 480, and a secondary transfer device 49. The image forming portion 4 includes a plurality of single-color image forming portions 411 respectively corresponding to cyan, magenta, yellow, and black.

Each single-color image forming portion 411 includes a photosensitive drum 41 which carries a toner image, a charging device 42, a developing device 43, a primary transfer device 45, a cleaning device 47, and the like. In each single-color image forming portion 411, the photosensitive drum 41 rotates at a peripheral velocity according to the peripheral velocity (movement velocity) of the intermediate transfer belt 48, and the charging device 42 charges the surface of the photosensitive drum 41 uniformly. Further, the laser scanning portion 5 scans a laser beam to draw an electrostatic latent image on the charged surface of the photosensitive drum 41. The photosensitive drum 41 is an example of a photosensitive body of the present disclosure.

The developing device 43 feeds toner to the photosensitive drum 41, thereby developing the electrostatic latent image. The developing device 43 in the present embodiment agitates a two-component developer 90 containing toner made from resin and carrier made from a magnetic material, thereby charging the toner, and feeds the charged toner to the photosensitive drum 41. The charging device 42 charges a part, of the photosensitive drum 41, on which the electrostatic latent image has not been drawn yet. The developing device 43 is detachable from the housing 100.

The intermediate transfer belt 48 is an endless belt-like member formed in a loop shape, and circulates being stretched between two rollers. In the image forming portion 4, each single-color image forming portion 411 forms an image for the corresponding color on the surface of the circulating intermediate transfer belt 48. Thus, a color image composed of overlaid images for the respective colors is formed on the intermediate transfer belt 48.

The secondary transfer device 49 transfers a toner image formed on the intermediate transfer belt 48 to the recording sheet 9. The cleaning device 480 removes the remaining toner on a part, of the intermediate transfer belt 48, that has passed through the secondary transfer device 49.

The sheet feed portion 2 includes a sheet reception portion 21 and a sheet sending portion 22. The sheet sending portion 22 sends the recording sheet 9 from the sheet reception portion 21 to a conveyance path 30. The sheet conveyance portion 3 includes a registration roller 31, a conveyance roller 32, a discharge roller 33, and the like. The registration roller 31 and the conveyance roller 32 convey the recording sheet 9 fed from the sheet feed portion 2, to the secondary transfer device 49 of the image forming portion 4. Further, the discharge roller 33 discharges the recording sheet 9 on which an image has been formed, onto a discharge tray 101 through a discharge port of the conveyance path 30.

The image forming apparatus 10 includes a manual feed tray 60. A sheet placed on the manual feed tray 60 is taken into the image forming apparatus 10 by a take-in roller 77, and conveyed through the conveyance path 30 to a transfer position of the secondary transfer device 49.

At an upper part of the housing 100, a top cover (not shown) which is openable and closable is provided. When the top cover is turned upward (open direction), the container installation portion 900 is exposed. The container installation portion 900 is provided above the image forming portion 4, and accommodates the toner containers 40. The toner containers 40 are provided at respective locations in the image forming portion 4. The toner containers 40 contain toners having colors corresponding to the respective colors of the image forming portion 4.

Figure 2:
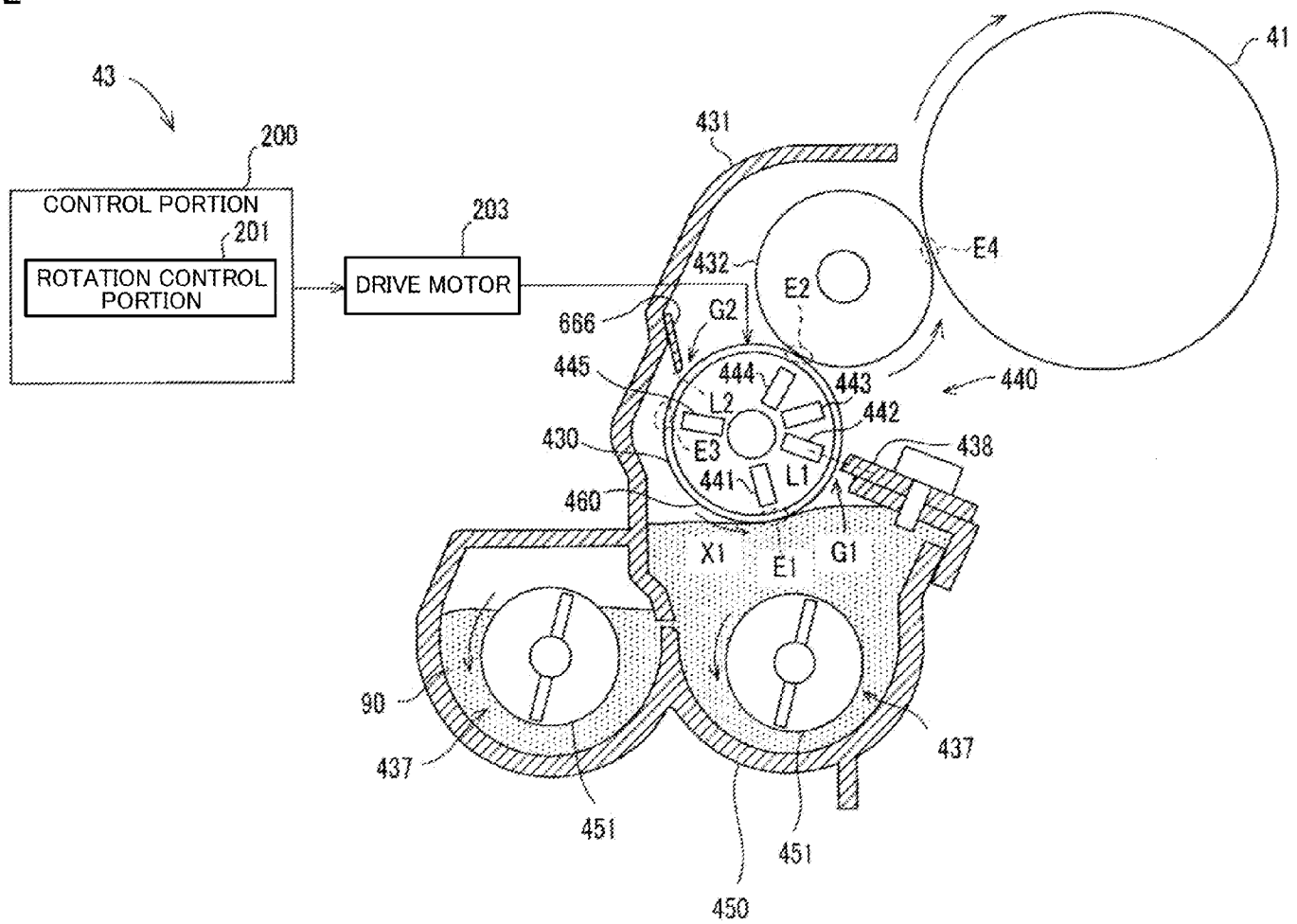
FIG. 2 is a schematic diagram showing the configuration of a developing device.

As shown in FIG. 2, the developing device 43 has a device body 431. In the device body 431, a magnetic roller 430, a developing roller 432, an agitation mechanism 437, and a blade 438 are provided. The magnetic roller 430, the developing roller 432, and the agitation mechanism 437 are rotatably supported around respective rotation shafts that are parallel with each other.

A lower part of the device body 431 is a developer reservoir 450 which stores the two-component developer 90. The toner fed from the toner container 40 is stored and accumulated in the developer reservoir 450.

The agitation mechanism 437 includes a screw member 451. The screw member 451 is a long member elongated along a direction perpendicular to the drawing plane of FIG. 2. The screw member 451 is made from resin. The screw member 451 is rotatably supported by side walls (not shown), of the developer reservoir 450, that are present at both ends in a direction perpendicular to the drawing plane of FIG. 2. By the screw member 451 rotating, the two-component developer 90 in the developer reservoir 450 is moved and agitated. By the agitation, the toner and the carrier are rubbed with each other. Static electricity caused by their friction charges the toner at a predetermined polarity. The carrier is charged at a polarity opposite to the charge polarity of the toner. By the electrostatic force, the toner is adhered to the carrier.

The magnetic roller 430 is provided inside the device body 431. The magnetic roller 430 attracts, by a magnetic force, the two-component developer 90 agitated by the agitation mechanism 437, from the developer reservoir 450, and carries the two-component developer 90. The magnetic roller 430 has a sleeve portion 460 and a magnetic pole portion 440.

The sleeve portion 460 has a cylindrical shape, and encloses the magnetic pole portion 440. The sleeve portion 460 is formed by a nonmagnetic member. The sleeve portion 460 is supported by the device body 431 so as to be rotatable in a forward direction and a reverse direction. In a development process, the sleeve portion 460 rotates in one direction. In the following description, the rotation direction of the sleeve portion 460 in the development process is referred to as a forward rotation direction X1. The forward rotation direction X1 corresponds to a first rotation direction. In the present embodiment, the forward rotation direction X1 is the counterclockwise direction in FIG. 2.

The magnetic pole portion 440 is provided inside the sleeve portion 460. In the magnetic pole portion 440, a plurality of magnets 441 to 445 are provided. The positions of the magnets 441 to 445 are fixed inside the sleeve portion 460. The plurality of magnets 441 to 445 are arranged via predetermined intervals therebetween along the circumferential direction of the sleeve portion 460.

The positional relationship among the magnets 441 to 445 in the present embodiment is set as follows: using the magnet 444 as a reference, the angle interval to the magnet 441 is 229.5 degrees, the angle interval to the magnet 442 is 273 degrees, the angle interval to the magnet 443 is 314.5 degrees, and the angle interval to the magnet 445 is 95.5 degrees.

The magnetic poles on the sleeve portion 460 side of the magnets 441 to 445 are alternately arranged along the circumferential direction of the sleeve portion 460. In the present embodiment, the magnetic poles on the sleeve portion 460 side of the magnets 441 to 445 are arranged such that the magnets 441, 443, 445 are S poles, and the magnets 442, 444 are N poles (see FIG. 3). FIG. 3 shows the distribution of the magnetic flux density in the normal direction of the sleeve portion 460, formed by the magnets 441 to 445.

Figure 3:
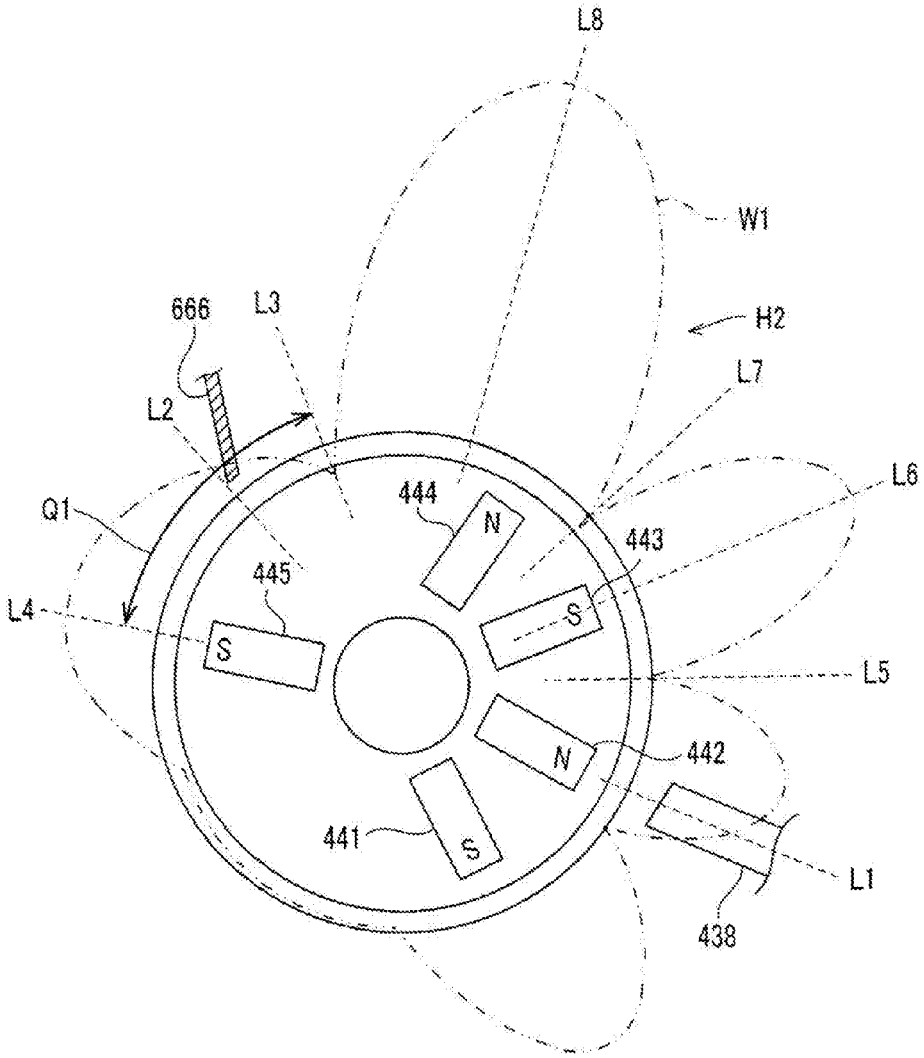
FIG. 3 is a schematic diagram showing the magnetic flux distribution of a plurality of magnets enclosed in a sleeve portion.

A curve W1 depicted by a two-dot dashed line in FIG. 3 indicates the magnitude of the magnetic flux density in the normal direction on the surface of the sleeve portion 460. That is, in FIG. 3, the magnitude of the magnetic flux density in the normal direction on the surface of the sleeve portion 460 is represented by undulation of the curve W1. As shown in FIG. 3, the magnetic flux density is maximized at a position, on the surface of the sleeve portion 460, that is close to the magnetic pole on the sleeve portion 460 side of each magnet 441 to 445, and decreases with increase in the distance from the position in the circumferential direction of the sleeve portion 460.

The magnet 441 is provided at a position that faces the two-component developer 90 in the developer reservoir 450, and attracts the two-component developer 90 stored in the developer reservoir 450. Thus, in a transfer region E1 of the surface of the sleeve portion 460, which faces the magnet 441, the two-component developer 90 is transferred and adhered to the sleeve portion 460.

The magnet 442 is provided at a position that faces the blade 438 described later, and magnetizes the blade 438. Thus, a magnetic field is formed in a gap G1 between the end of the blade 438 and the magnet 442. When the two-component developer 90 adhered to the surface of the sleeve portion 460 by the magnet 441 passes through the gap G1, the two-component developer 90 is magnetically held in the gap G1 by the magnetic field and the layer thickness of the two-component developer 90 is regulated by the blade 438. Thus, a developer layer having a uniform layer thickness is formed on the surface of the sleeve portion 460.

The magnet 443 is provided at a position that is on the downstream side relative to the magnet 442 in the forward rotation direction X1 and is adjacent to the magnet 442. The magnet 443 causes the sleeve portion 460 to carry the two-component developer 90 thereon. On the developer layer formed on the sleeve portion 460, a magnetic brush is formed. The magnetic brush is a plurality of chain bodies formed by the carriers which are contained in the two-component developer 90 and which are linked in a chain form from the surface of the sleeve portion 460 by magnetic forces of the magnets 441 to 445.

Figure 4A:
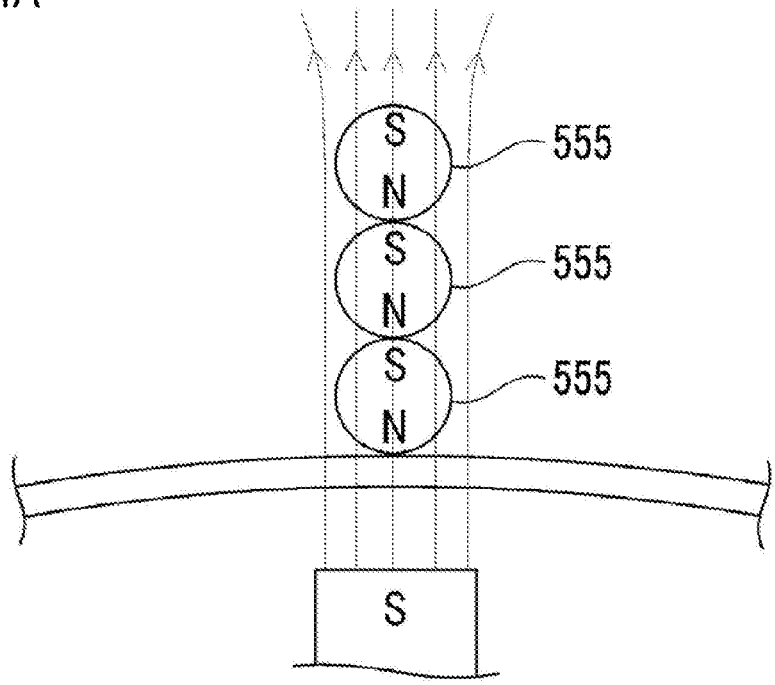
FIG. 4A and FIG. 4B are diagrams for explaining magnetization of carrier.
Figure 4B:
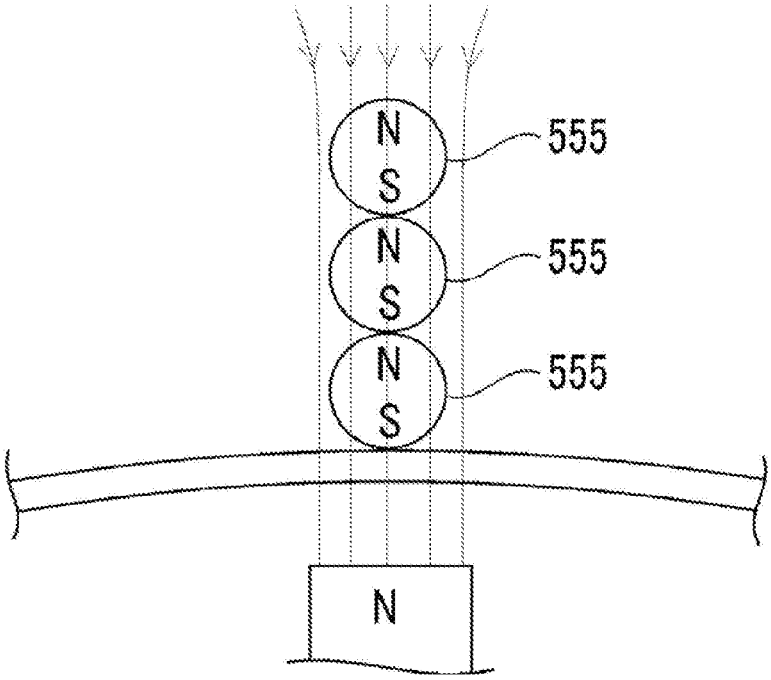

More specifically, the carriers are made from a magnetic material. Therefore, the carriers are magnetized by the magnetic fields of the magnets 441 to 445, and S poles and N poles are generated in the magnets 441 to 445 themselves. The magnetic poles generated in the carriers are arranged along the magnetic field lines extending from or entering the magnetic poles of the magnets 441 to 445. For example, in the case of approaching the S pole of the magnet, as shown in FIG. 4A, in each carrier, an N pole is generated at a part close to the S pole of the magnet and an S pole is generated at a part far from the S pole of the magnet, so as to be arranged along the magnetic field lines extending from the S pole of the magnet. On the other hand, in the case of approaching the N pole of the magnet, as shown in FIG. 4B, in each carrier, an S pole is generated at a part close to the N pole of the magnet and an N pole is generated at a part far from the N pole of the magnet, so as to be arranged along the magnetic field lines entering the N pole of the magnet.

Such magnetization occurs in each particle of the carriers, and the particles of the carriers are attracted to each other by attractive forces due to magnetic forces generated between the different poles. Thus, the carriers are linked to form the chain body. Then, a plurality of such chain bodies are formed, whereby the magnetic brush is formed.

The magnetic force acting on the outer circumferential surface of the sleeve portion 460 due to each magnetic pole of the magnets 441 to 445 is maximized at a position that faces the center position of the magnetic pole surface on the sleeve portion 460 side of each magnet 441 to 445. Therefore, at the position that faces the center position of the magnetic pole surface, more carriers congest to be linked in a chain form. That is, at the position that faces the center position of the magnetic pole surface, the length of the chain body is maximized. Therefore, the layer thickness of the magnetic brush is maximized at the position that faces the center position of the magnetic pole surface of each magnet 441 to 445.

The magnets 441 to 445 are arranged such that the magnetic field line extending from or entering the center position of each magnetic pole surface is along the normal direction of the sleeve portion 460. Therefore, at the position that faces the magnetic pole surface of each magnet 441 to 445, the magnetic brush erects along the normal direction. In a region other than the center position, the magnetic field line forms an arc that curves outward. Therefore, at the periphery of the center position, the magnetic brush is tilted.

Thus, the magnetic brush gradually becomes close to the erecting state as approaching the center position of the magnetic pole surface on the sleeve portion 460 side of each magnet 441 to 445, and becomes the erecting state at the position that faces the center position. The magnetic brush is gradually tilted as departing from the position that faces the center position.

Different voltages are respectively applied to the sleeve portion 460 and the developing roller 432, and a predetermined potential difference is generated between the sleeve portion 460 and the developing roller 432. Owing to the potential difference, the toner contained in the two-component developer 90 carried on the sleeve portion 460 is transferred and adhered to the developing roller 432. The transfer of the toner mainly occurs in a certain region including the position closest to the developing roller 432, of the sleeve portion 460. Hereinafter, this region E2 is referred to as a transfer region E2. The transfer region E2 is an example of a first region of the present disclosure.

The magnet 444 is provided at a position that faces the developing roller 432, and attracts, onto the surface of the sleeve portion 460, the carrier left on the sleeve portion 460 after the toner has been transferred to the developing roller 432 in the transfer region E2. The carrier attracted onto the surface of the sleeve portion 460 by the magnet 444 keeps formation of the magnetic brush.

The magnet 445 generates a magnetic force in a direction to separate the two-component developer 90 from the sleeve portion 460, in a separation region E3 which is on the downstream side in the forward rotation direction X1 relative to the transfer region E2 on the outer circumferential surface of the sleeve portion 460. Thus, after the toner has been transferred to the developing roller 432 in the transfer region E2, the magnet 445 separates the carrier left on the surface of the sleeve portion 460 from the surface by the magnetic force in the separation region E3, thereby dropping the carrier to the developer reservoir 450 below. The separation region E3 is an example of a second region of the present disclosure. The magnet 445 is an example of a magnetic pole member of the present disclosure.

In the development process, the sleeve portion 460 receives and carries the two-component developer 90 from the developer reservoir 450 in the transfer region E1 by the magnetic force of the magnet 441, and conveys the two-component developer 90 by rotating in the forward rotation direction X1. When the two-component developer 90 is conveyed to the transfer region E2 by the sleeve portion 460, the toner contained in the two-component developer 90 is transferred to the developing roller 432 at the next stage by the potential difference between the sleeve portion 460 and the developing roller 432. At this time, the two-component developer 90 in which the proportion of the carrier 555 is high is left on the surface of the sleeve portion 460. The sleeve portion 460 is an example of a developer carrying body of the present disclosure.

The sleeve portion 460 further rotates in the forward rotation direction X1, to convey the two-component developer 90 in the forward rotation direction X1. Then, when the two-component developer 90 reaches the separation region E3, the two-component developer 90 is separated from the sleeve portion 460. This is because the range of the magnetic field lines extending from the magnet 441 to the developer reservoir 450 side is very small due to the influence of the magnet 445 which has the same magnetic pole on the sleeve portion 460 side as that of the magnet 441, and therefore the magnetic attractive force applied to the two-component developer 90 from the magnet 441 disappears. The two-component developer 90 separated from the sleeve portion 460 drops to the developer reservoir 450 below.

The blade 438 is provided via the gap G1 from the surface of the sleeve portion 460, at a position L1 on the upstream side in the forward rotation direction X1 relative to the transfer region E2 on the outer circumference of the sleeve portion 460. The blade 438 limits the layer thickness of the two-component developer 90 carried on the sleeve portion 460 rotating in the forward rotation direction X1. Hereinafter, the position L1 is referred to as a first layer thickness limiting position L1. The first layer thickness limiting position L1 is an example of a first specific position of the present disclosure. The blade 438 is an example of a layer thickness limiting member of the present disclosure.

The developing roller 432 is provided being opposed to the sleeve portion 460. The developing roller 432 receives the toner from the sleeve portion 460 carrying the two-component developer 90, and carries the received toner.

The developing roller 432 is opposed to the photosensitive drum 41 in a contactless manner. As described above, voltage is applied to the developing roller 432. Thus, a predetermined potential difference is generated between the developing roller 432 and the electrostatic latent image formed on the photosensitive drum 41. Owing to the potential difference, in a transfer region E4, the toner carried on the developing roller 432 is transferred to a part corresponding to the electrostatic latent image formed on the outer circumferential surface of the photosensitive drum 41. Thus, the electrostatic latent image is developed. The developing roller 432 conveys the toner to the transfer region E4 for passing the toner to the photosensitive drum 41 having the electrostatic latent image formed on the surface thereof. The developing roller 432 is an example of a toner carrying body.

In the development process, the developing roller 432 rotates in the same direction as the sleeve portion 460. Thus, the mutually opposed portions of the outer circumferential surfaces of the sleeve portion 460 and the developing roller 432 respectively move in the opposite directions.

In the development process, the developing roller 432 and the photosensitive drum 41 respectively rotate in the opposite directions. Thus, the mutually opposed portions of the outer circumferential surfaces of the developing roller 432 and the photosensitive drum 41 move in the same direction.

Thus, the toner 777 contained in the two-component developer 90 is consumed in the development process. Therefore, the toner 777 is supplied from the toner container 40 to the developer reservoir 450, to compensate the consumption. Meanwhile, the carrier 555 contained in the two-component developer 90 is hardly consumed but is left in the developer reservoir 450, and gives fluidity and the like to the toner 777 supplied to the developer reservoir 450.

The developing device 43 has a drive motor 203. The drive motor 203 rotationally drives the sleeve portion 460. The drive motor 203 may be a DC brushless motor, a stepping motor, or the like.

The developing device 43 has a control portion 200. The control portion 200 includes a CPU (Central Processing Unit), a ROM (Read Only Memory), and a RAM (Random Access Memory).

The CPU is a processor that executes various calculation processes. The ROM is a nonvolatile storage portion in which information such as a control program for causing the CPU to execute the various processes is stored in advance. The RAM is a volatile storage portion used as a temporary storage memory (working area) for the various processes executed by the CPU. The control portion 200 causes the CPU to execute the control program stored in the ROM, thereby controlling operation of the image forming apparatus 10.

In the ROM of the control portion 200, a processing program for causing the CPU of the control portion 200 to execute a rotation process described later (see a flowchart in FIG. 5) is stored. The processing program may be stored in the ROM at a stage of shipment of the image forming apparatus 10. Alternatively, the processing program may be stored in a computer-readable non-transitory information storage medium such as a CD, a DVD, or a flash memory, and then after the shipment, the processing program may be stored into the ROM of the control portion 200 from the information storage medium. In another embodiment, a part or a plurality of the functions of the control portion 200 may be provided as an electronic circuit.

The control portion 200 functions as a rotation control portion 201 by the CPU executing the processing program stored in the ROM.

During execution of the development process, the rotation control portion 201 performs forward rotation control to rotate the sleeve portion 460 in the forward rotation direction X1 at a predetermined first rotation velocity V1. In addition, at a predetermined timing excluding a period during which the development process is executed, the rotation control portion 201 performs reverse rotation control to rotate the sleeve portion 460 in a rotation direction (hereinafter, referred to as a reverse rotation direction) X2 opposite to the forward rotation direction X1 at a rotation velocity V2 which is the same as or different from the first rotation velocity V1. The reverse rotation direction X2 corresponds to a second rotation direction of the present disclosure.

In the case where control for rotating the sleeve portion 460 in the reverse rotation direction X2 is performed in the image forming apparatus 10, technology for further enhancing the performance for removing the accumulated toner from the surface of the blade 438 is required. Considering this, in the developing device 43 and the image forming apparatus 10 according to the present embodiment, the performance for removing the accumulated toner from the blade 438 which limits the layer thickness of the two-component developer on the surface of the sleeve portion 460 is enhanced as described below.

As shown in FIG. 2, the developing device 43 includes a sheet member 666. The sheet member 666 is attached at a predetermined position on the inner wall of the device body 431. The sheet member 666 extends along the rotation axis of the sleeve portion 460, and has a rectangular shape. The sheet member 666 is mainly composed of, for example, urethane, and is elastic or flexible.

The sheet member 666 in a natural state extends toward a part at a position L2 between the transfer region E2 and the separation region E3 on the outer circumference of the sleeve portion 460. That is, the position L2 is on the upstream side in the forward rotation direction X1 relative to the separation region E3, and on the downstream side in the forward rotation direction X1 relative to the transfer region E2. The position L2 is an example of a second specific position of the present disclosure. Hereinafter, the position L2 is referred to as a second layer thickness regulating position L2.

When the sheet member 666 is in a natural state, the end of the sheet member 666 reaches a position separated from the surface of the sleeve portion 460 by a predetermined distance. In other words, a gap G2 having a length corresponding to the predetermined distance is provided between the end of the sheet member 666 and the second layer thickness regulating position L2 on the surface of the sleeve portion 460. The gap G2 will be described later.

The sheet member 666 enables further enhancement of the performance for removing the accumulated toner from the surface of the blade 438.

Figure 5:
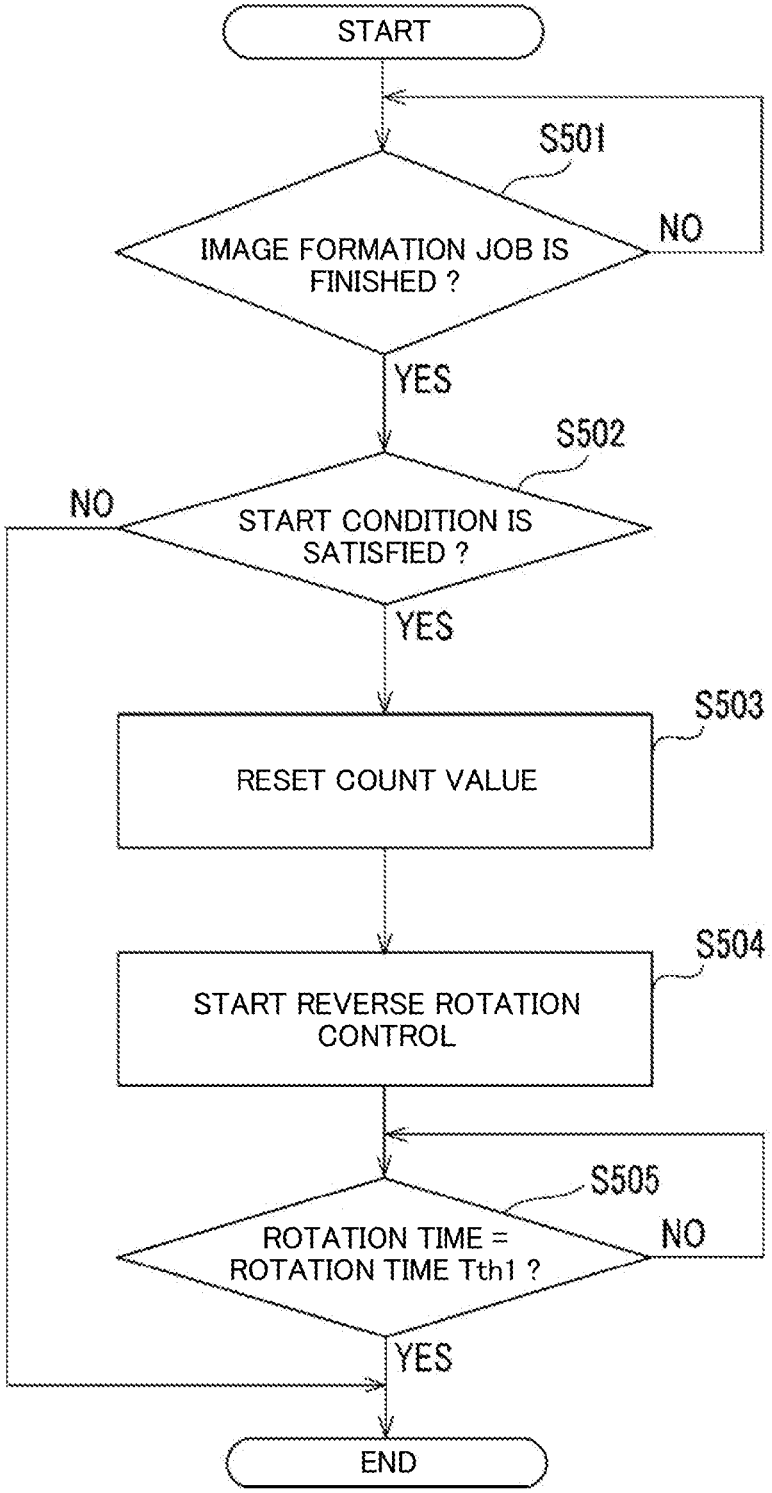
FIG. 5 is a flowchart showing a rotation process for the sleeve portion by a control portion.

With reference to FIGS. 5 to 10, the rotation process for the sleeve portion 460 by the control portion 200 will be described. In the flowchart in FIG. 5, steps S501, S502, . . . indicate the numbers of steps in the processing procedure. The process by the control portion 200 shown in FIG. 5 is started when an image formation job accompanied by the development process is executed.

<Step S501>

In step S501, the control portion 200 determines whether or not the image formation job has been finished. If it is determined that the image formation job has not been finished (NO in step S501), the control portion 200 executes the processing in step S501 again.

Figure 6A:
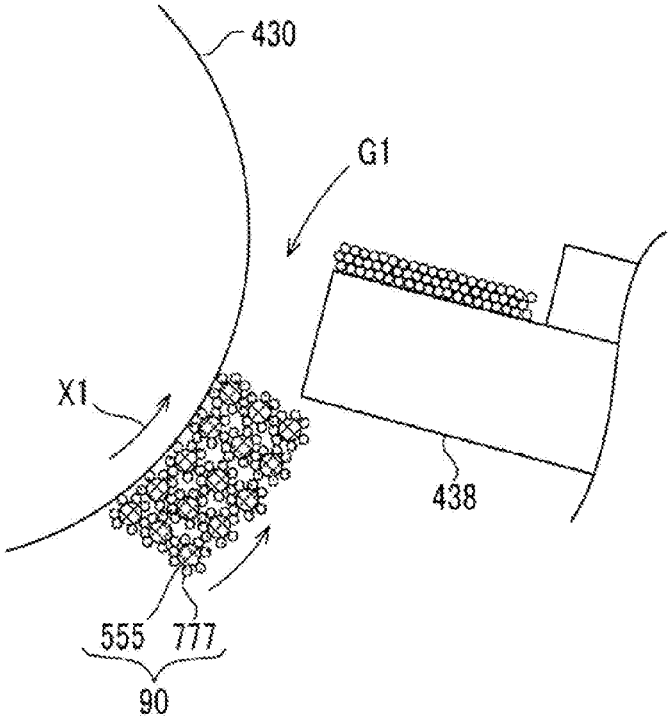
FIG. 6A and FIG. 6B are diagrams for explaining a layer thickness limiting function of a blade when the sleeve portion rotates forward.
Figure 6B:
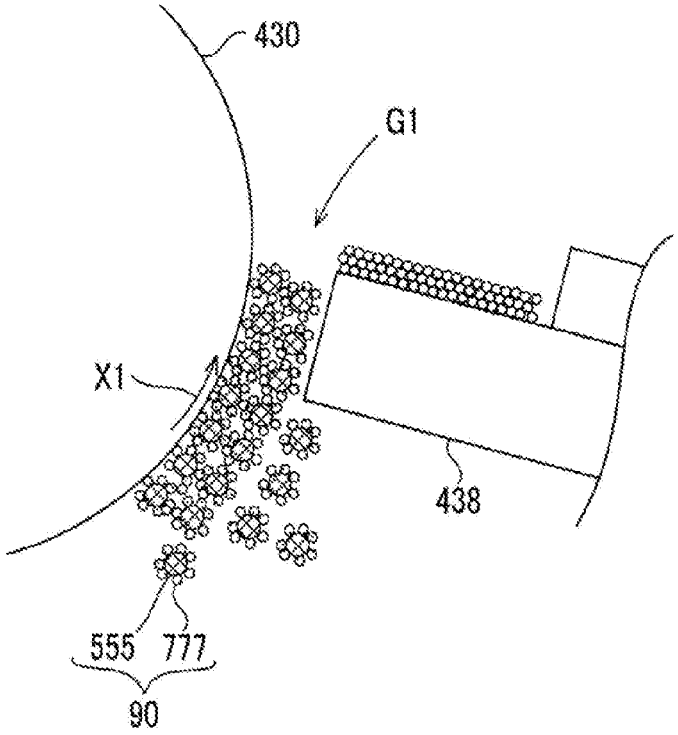
Figure 7:
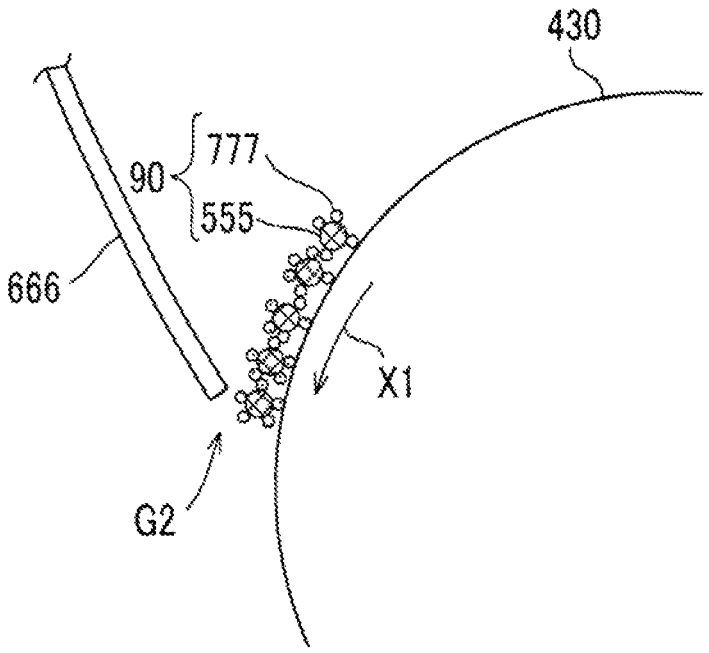
FIG. 7 is a diagram showing the states of a two-component developer and a sheet member when the sleeve portion rotates forward.

During execution of the image formation job, the rotation control portion 201 performs the forward rotation control to rotate the sleeve portion 460 in the forward rotation direction X1 (see FIG. 6A). In the forward rotation control, when the two-component developer 90 carried on the surface of the sleeve portion 460 enters the gap G1 between the end of the blade 438 and the magnet 442, the layer thickness is limited by the blade 438 (see FIG. 6B).

On the other hand, in the forward rotation control, the sheet member 666 is in a natural state so that the end of the sheet member 666 reaches the position separated from the surface of the sleeve portion 460 by a predetermined distance.

Here, as described above, the second layer thickness regulating position L2 is a position between the transfer region E2 and the separation region E3. In more detail, between the transfer region E2 and the separation region E3, the second layer thickness regulating position L2 is within a range from the position L3 at which the magnetic flux density is minimized to a position L4 at which the magnetic flux density is maximized by the magnet 445 (see arrow Q1 in FIG. 3). The position L4 is a position within the separation region E3. The region between the position L3 and the position L4 is an example of a specific region of the present disclosure.

In the region from the position L3 to the position L4, the magnetic flux density gradually increases in the forward rotation direction X1. Therefore, when the sleeve portion 460 rotates in the forward rotation direction X1, the second layer thickness regulating position L2 is a position through which the height of the magnetic brush is increasing from a low state. On the other hand, when the sleeve portion 460 rotates in the reverse rotation direction X2, the second layer thickness regulating position L2 is a position through which the height of the magnetic brush is decreasing from a high state. In other words, when the sleeve portion 460 rotates in the forward rotation direction X1, the second layer thickness regulating position L2 is a position through which the layer thickness of the two-component developer 90 is increasing from a thin state, and when the sleeve portion 460 rotates in the reverse rotation direction X2, the second layer thickness regulating position L2 is a position through which the layer thickness of the two-component developer 90 is decreasing from a thick state.

Therefore, the second layer thickness regulating position L2 is a position at which, due to the magnetic force of the magnet 445, the layer thickness of the two-component developer 90 when entering the gap G2 in the case of rotation in the reverse rotation direction X2 is greater than in the case of rotation in the forward rotation direction X1.

When the sleeve portion 460 rotates in the forward rotation direction X1, the distance from the end of the sheet member 666 to the surface of the sleeve portion 460 is longer than the layer thickness of the two-component developer that is approaching the second layer thickness regulating position L2 from the transfer region E2. Therefore, in the forward rotation control for the sleeve portion 460, the two-component developer 90 approaching the second layer thickness regulating position L2 from the transfer region E2 passes under the sheet member 666 without colliding therewith (see FIG. 7).

In step S501, if it is determined that the image formation job has been finished (YES in step S501), the control portion 200 advances the process to step S502.

<Step S502>

After determining that the image formation job has been finished, the control portion 200 determines whether or not a start condition for starting the reverse rotation control of the sleeve portion 460 has been satisfied. The start condition may be that, for example, the count value of a counter (not shown) described later exceeds a numerical value indicating a predetermined number of sheets. The numerical value is, for example, 10000.

If it is determined that the start condition has not been satisfied (NO in step S502), the control portion 200 ends the process. On the other hand, if it is determined that the start condition has been satisfied (YES in step S502), the control portion 200 advances the process to step S503.

<Step S503>

In step S503, the control portion 200 resets the count value of the counter. The counter counts the number of the recording sheets 9 on which images have been formed. For example, the counter may be realized by the CPU executing a program for counting up the number of times the image formation process has been executed, in the control portion 200. After the processing in step S503, the control portion 200 advances the process to step S504.

<Step S504>

In step S504, the control portion 200 starts the reverse rotation control for the sleeve portion 460. Under the reverse rotation control, the control portion 200 rotates the sleeve portion 460 in the reverse rotation direction X2.

Here, as described above, in the rotation in the reverse rotation direction X2, the second layer thickness regulating position L2 is a position through which the layer thickness of the two-component developer 90 is decreasing from a thick state. In addition, in the case where the sleeve portion 460 rotates in the reverse rotation direction X2, the layer thickness of the two-component developer 90 when entering the gap G2 between the end of the sheet member 666 and the surface of the sleeve portion 460 is greater than in the case where the sleeve portion 460 rotates in the forward rotation direction X1.

In addition, the distance from the end of the sheet member 666 to the surface of the sleeve portion 460 is shorter than the layer thickness of the two-component developer 90 that is approaching the second layer thickness regulating position L2 from the separation region E3 in the reverse rotation control for the sleeve portion 460. Therefore, in the reverse rotation control for the sleeve portion 460, a part of the two-component developer 90 approaching the second layer thickness regulating position L2 from the separation region E3 collides with the sheet member 666 (see FIG. 8A). Therefore, a part of the two-component developer 90 is dammed by the sheet member 666. That is, the layer thickness of the two-component developer 90 carried on the sleeve portion 460 rotating in the reverse rotation direction X2 is limited.

The two-component developer 90 dammed by the sheet member 666 receives a conveyance force in the reverse rotation direction X2 from the sleeve portion 460 rotating in the reverse rotation direction X2. Thus, the sheet member 666 is pressed with a pressing force F1 in the reverse rotation direction X2 from the two-component developer 90 dammed by the sheet member 666 (see FIG. 8A).

Figure 8A:
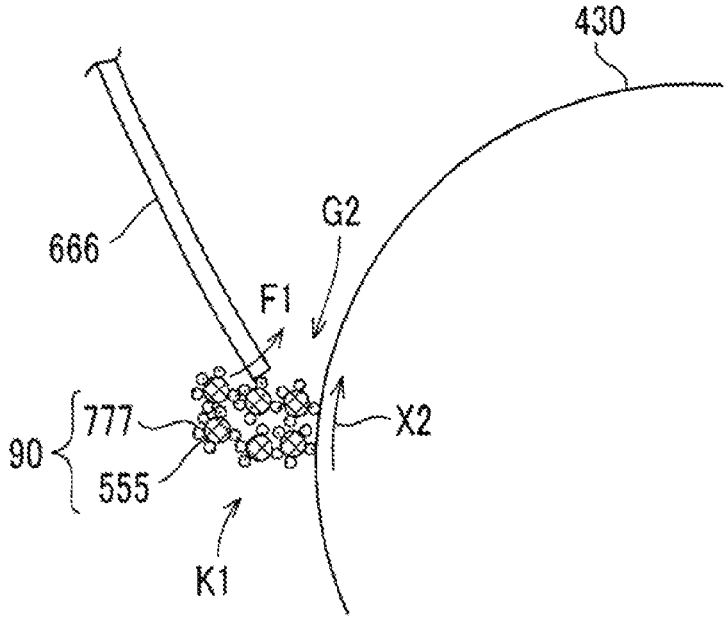
FIG. 8A and FIG. 8B are diagrams showing the states of the two-component developer and the sheet member when the sleeve portion rotates reversely.
Figure 8B:
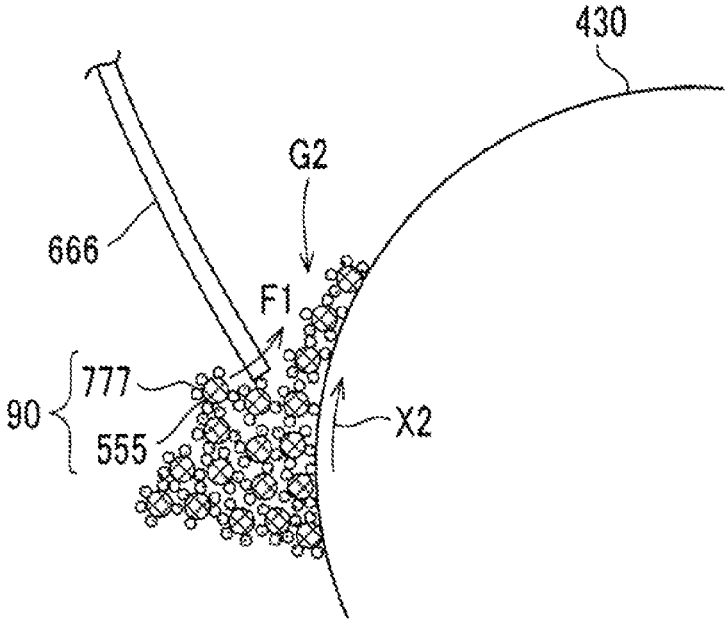

As the sleeve portion 460 rotates in the reverse rotation direction X2, the two-component developer 90 dammed by the sheet member 666 increases (see FIG. 8B). Thus, a mass of the two-component developer 90 is generated and the mass gradually enlarges. Then, as the mass of the two-component developer 90 gradually enlarges, the pressing force F1 in the reverse rotation direction X2 applied to the sheet member 666 from the mass of the two-component developer 90 increases.

Figure 9A:
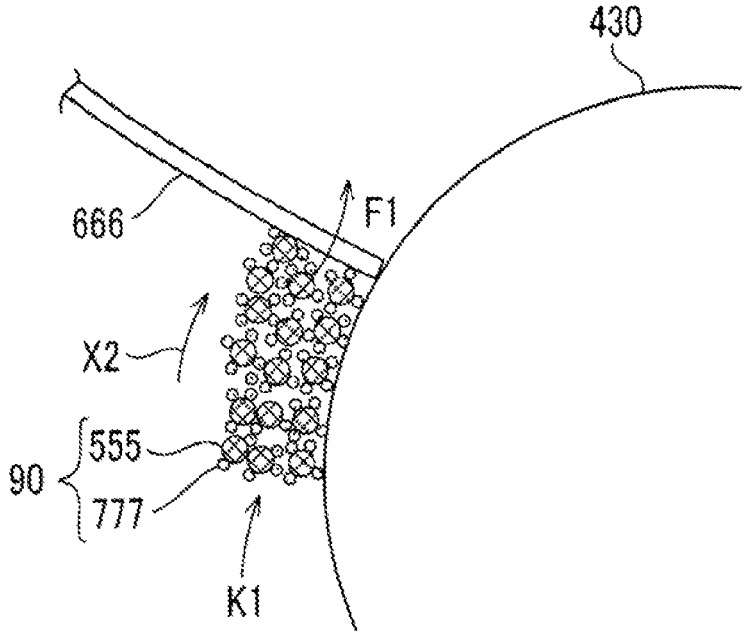
FIG. 9A and FIG. 9B are diagrams showing the states of the two-component developer and the sheet member when the sleeve portion rotates reversely.
Figure 9B:
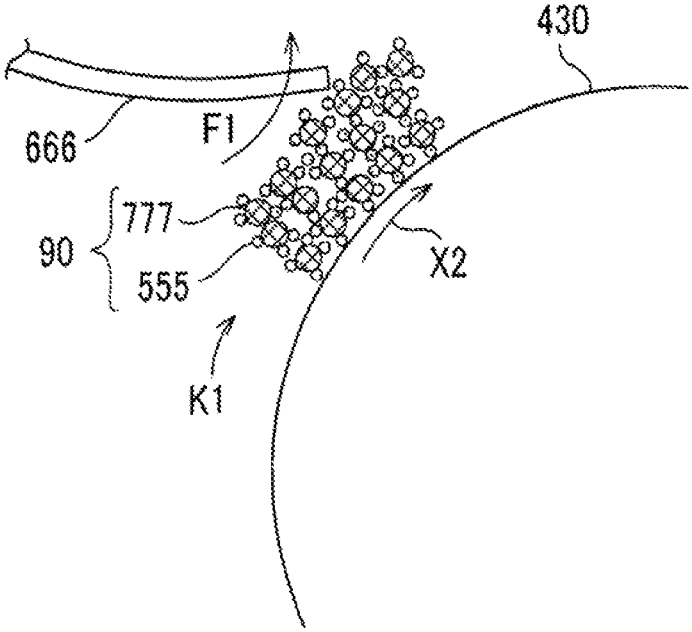

When the sheet member 666 becomes unable to keep the natural state due to the pressing force F1 equal to or greater than a tolerable value being applied in the reverse rotation direction X2, the sheet member 666 starts to elastically deform (see FIG. 9A), and then is bent toward the downstream side in the reverse rotation direction X2 (see FIG. 9B). Thus, the mass of the two-component developer 90 that has been dammed by the sheet member 666 passes under the bent sheet member 666 and passes through the gap G2.

Figure 10A:
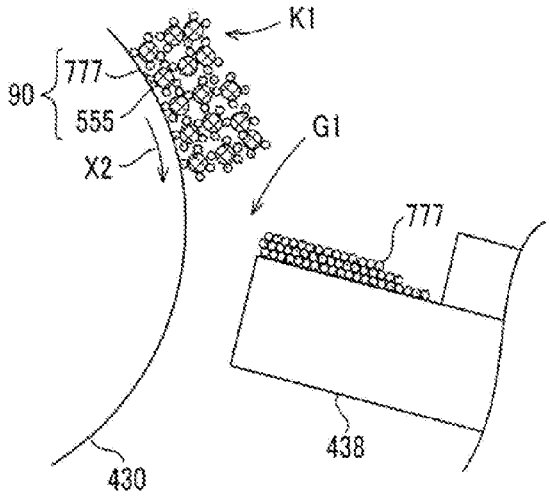
FIG. 10A, FIG. 10B, and FIG. 10C are diagrams for explaining a removal process for accumulated toner on the blade when the sleeve portion rotates reversely.
Figure 10B:
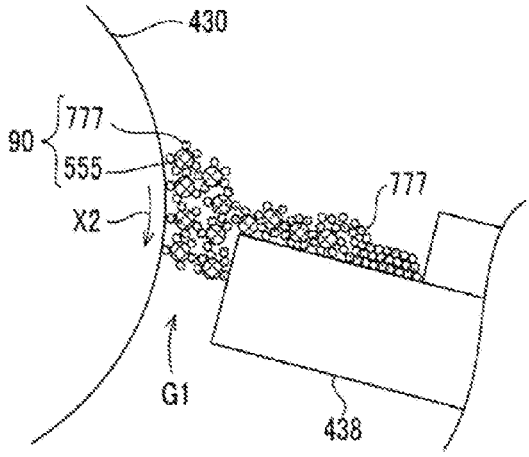

After passing under the sheet member 666, the mass of the two-component developer 90 approaches the surface of the blade 438 (see FIG. 10A). A part of the mass of the two-component developer 90 is caught on the upper surface of the blade 438. The two-component developer 90 caught on the upper surface of the blade 438 runs onto the upper surface of the blade 438 while dispersing, to come into contact with the toner accumulated on the upper surface (see FIG. 10B).

The carrier 555 contained in the two-component developer 90 that has run onto the upper surface of the blade 438 has a polarity electrically opposite to that of the toner 777 accumulated on the upper surface of the blade 438. Therefore, the toner 777 accumulated on the upper surface of the blade 438 is adhered to the carrier 555 on the upper surface of the blade 438 by an electrostatic force.

Figure 10C:
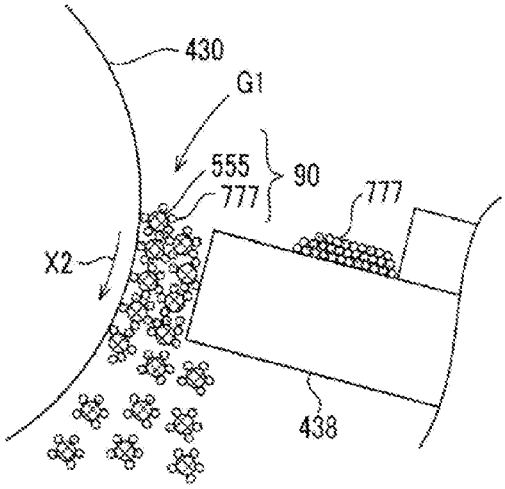

The carrier 555 to which the toner 777 has been adhered, i.e., the two-component developer 90 is attracted to the sleeve portion 460 by an electrostatic force, and then drops through the gap G1 toward the developer reservoir 450 (see FIG. 10C). Thus, the toner 777 accumulated on the upper surface of the blade 438 is scraped by the magnetic brush K1.

After the processing in step S504, the control portion 200 advances the process to step S505.

<Step S505>

The control portion 200 determines whether or not a rotation time under the reverse rotation control for the sleeve portion 460 has reached a predetermined rotation time Tth1. The rotation time Tth1 is at least a time needed for the mass of the two-component developer 90 to be formed by the sheet member 666 damming the two-component developer 90 and then to reach the position of the blade 438 by pushing away the sheet member 666.

If it is determined that the rotation time has not reached the rotation time Tth1 (NO in step S505), the control portion 200 executes the processing in step S505 again. On the other hand, if it is determined that the rotation time has reached the rotation time Tth1 (YES in step S505), the control portion 200 ends the process.

Here, the reverse rotation control is finished when the rotation time reaches the rotation time Tth1. However, a sensor for detecting that the reverse rotation angle reaches a desired angle may be provided, and the reverse rotation control may be finished as a result of the detection by the sensor.

Thus, the image forming apparatus 10 has the sheet member 666 for damming a part of the two-component developer 90 carried on the surface of the sleeve portion 460 and generating a mass of the two-component developer 90 when the sleeve portion 460 rotates in the reverse rotation direction X2. When the sheet member 666 receives a pressing force equal to or greater than a tolerable value in the reverse rotation direction X2 from the mass of the two-component developer 90, the sheet member 666 elastically deforms to release the damming of the two-component developer 90. Then, by the release of the damming, the image forming apparatus 10 causes the mass of the two-component developer 90 conveyed to the blade 438 to come into contact with the toner 777 accumulated on the upper surface of the blade 438, thereby removing the toner 777 from the upper surface of the blade 438.

Thus, as compared to the conventional configuration having no sheet member 666, the amount of the carrier 555 to which the toner 777 accumulated on the upper surface of the blade 438 is adhered increases, whereby the performance for removing toner can be improved as compared to the conventional configuration.

While preferred embodiments of the present disclosure have been described above, the present disclosure is not limited to the above content, but various modifications may be applied.

(1) In the above embodiment, the sheet member 666 has a rectangular shape. However, in this case, in the reverse rotation of the sleeve portion 460, when the sheet member 666 contacts with the two-component developer 90 on the surface of the sleeve portion 460, the toner is scattered by, mainly, corner portions at both ends of the sheet member 666.

Figure 11:
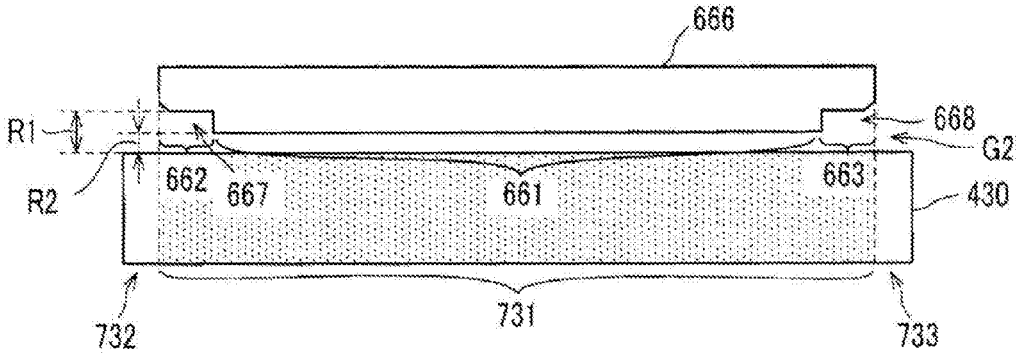
FIG. 11 is a diagram showing the configuration of a sheet member in a second embodiment of the present disclosure.

Considering this, in the present embodiment, as shown in FIG. 11, the sheet member 666 having a long shape along the rotational axis of the sleeve portion 460 has cutouts 667 and 668 at both ends in the rotation axis direction. That is, the sheet member 666 is configured such that a length R1 of the gap G2 between the sheet member 666 and the sleeve portion 460 in end regions 662 and 663 in predetermined ranges from both ends in the rotation axis direction is greater than a length R2 of the gap G2 between the sheet member 666 and the sleeve portion 460 in a central region 661 which is a region other than the end regions 662 and 663. The cutouts 667 and 668 are an example of a limitation moderating portion of the present disclosure.

The sleeve portion 460 has a carrying region 731 which allows the two-component developer 90 to be carried thereon, and non-carrying regions 732 and 733 which are provided on both sides in the axial direction of the carrying region 731 and on which the two-component developer 90 is not carried. In the present embodiment, the length of the sheet member 666 is the same as the axial length of the carrying region 731 of the sleeve portion 460.

Thus, it becomes possible to prevent the toner from being scattered by corner portions at both ends of the sheet member 666 when the sheet member 666 dams a part of the magnetic brush on the surface of the sleeve portion 460 during the reverse rotation of the sleeve portion 460.

(2) In the above embodiment, the second layer thickness regulating position L2 is a position between the transfer region E2 and the separation region E3 on the outer circumference of the sleeve portion 460, or a position between the position L3 at which the magnetic flux density is minimized and the position L4 at which the magnetic flux density is maximized due to the magnet 445. However, the second layer thickness regulating position L2 is not limited to a position between the position L3 and the position L4, as long as the second layer thickness regulating position L2 is a position at which, due to the magnetic force of the magnet 445, the layer thickness of the two-component developer 90 when entering the gap G2 in the case of rotation in the reverse rotation direction X2 is greater than in the case of rotation in the forward rotation direction X1.

For example, the second layer thickness regulating position L2 may be a position between a position L5 at which the magnetic flux density is minimized between the magnet 442 and the magnet 443, and a position L6 at which the magnetic flux density is maximized due to the magnet 443. Alternatively, the second layer thickness regulating position L2 may be a position between a position L7 at which the magnetic flux density is minimized between the magnet 443 and the magnet 444, and a position L8 at which the magnetic flux density is maximized due to the magnet 444. The region between the position L5 and the position L6, and the region between the position L7 and the position L8 are examples of a specific region of the present disclosure.

However, when the sheet member 666 elastically returns to the natural state after the mass of the two-component developer has passed, the two-component developer adhered to the surface of the sheet member 666 might be scattered. If the scattered two-component developer is adhered to the developing roller 432, the image quality is adversely affected. Therefore, it is preferable that the second layer thickness regulating position L2 is a position between the position L3 and the second layer thickness regulating position L2.

In the above embodiment, the mass of the two-component developer 90 is generated on the surface on the downstream side in the forward rotation direction X1, of the sheet member 666. However, without limitation thereto, in some embodiments, the mass of the two-component developer 90 may be generated on the surface on the upstream side in the forward rotation direction X1, of the sheet member 666.

In this case, the second layer thickness regulating position L2 may be a position between the first layer thickness limiting position L1 and the position L5, a position between the position L6 and the position L7, or a position between the position L8 and the position L3. The region between the position L1 and the position L5, the region between the position L6 and the position L7, and the region between the position L8 and the position L3 are examples of a specific region of the present disclosure. In this case, the sheet member 666 elastically deforms when the sheet member 666 becomes unable to keep the natural state due to the pressing force F1 equal to or greater than a tolerable value being applied in the forward rotation direction X1.

(3) The developing device 43 according to the above embodiment is a device that develops an electrostatic latent image on the surface of the photosensitive drum 41 by a so-called interactive touchdown method. However, the developing device provided in the image forming apparatus 10 is not limited thereto. That is, the developing device provided in the image forming apparatus 10 may be a developing device of a type in which the magnetic roller 430 is not provided and the developing roller 432 receives the two-component developer 90 stored in the developer reservoir 450 and supplies the toner to the photosensitive drum 41. In this case, the developing roller 432 corresponds to a developer carrying body that carries the agitated two-component developer 90, and the photosensitive drum 41 corresponds to a toner carrying body.

(4) When the reverse rotation control by the rotation control portion 201 has been finished, the rotation control portion 201 may rotate the sleeve portion 460 in the forward rotation direction X1 in advance in preparation for generation of an image formation job. Thus, when an image formation job is generated, the developer layer has been already formed on the surface of the sleeve portion 460. Therefore, the generated image formation job can be swiftly executed.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing device comprising:

a developer reservoir in which a two-component developer is stored;

a developer carrying body supported so as to be rotatable in a first rotation direction and a second rotation direction, the developer carrying body being configured to rotate in the first rotation direction, thereby carrying the two-component developer stored in the developer reservoir on an outer circumferential surface of the developer carrying body and feeding, in a first region on the outer circumferential surface, toner contained in the two-component developer to a toner carrying body at a next stage;

a magnetic pole member configured to generate a magnetic force in a direction to separate the two-component developer from the developer carrying body, in a second region on a downstream side in the first rotation direction relative to the first region on the outer circumferential surface of the developer carrying body;

a layer thickness limiting member provided via a gap at a first specific position on an upstream side in the first rotation direction relative to the first region on the outer circumferential surface of the developer carrying body, the layer thickness limiting member being configured to limit a layer thickness of the two-component developer carried on the developer carrying body rotating in the first rotation direction; and a sheet member provided via a gap at a second specific position in a specific region between a position on a downstream side in the first rotation direction relative to the first specific position, and a high-magnetic-force position at which an intensity of the magnetic force is the highest in the second region, on the outer circumferential surface of the developer carrying body, the sheet member being configured to limit a layer thickness of the two-component developer carried on the developer carrying body rotating in the second rotation direction, the sheet member being able to elastically deform in accordance with application of a pressing force equal to or greater than a tolerable value in the first rotation direction or the second rotation direction.

2. The developing device according to claim 1, wherein the second specific position is a position at which, due to a magnetic force of the magnetic pole member, the layer thickness of the two-component developer when entering a location where the layer thickness is limited by the sheet member in the case of rotation in the second rotation direction is greater than in the case of rotation in the first rotation direction, and the gap between the sheet member and the developer carrying body has a length that allows the sheet member to dam a part of the two-component developer when the developer carrying body rotates in the second rotation direction.

3. The developing device according to claim 1, wherein the second specific position is on an upstream side in the first rotation direction relative to the high-magnetic-force position, in the second region.

4. The developing device according to claim 1, wherein the sheet member has a long shape along a rotation axis of the developer carrying body, and has a limitation moderating portion such that the gap between the sheet member and the developer carrying body in end regions in predetermined ranges from both ends in the rotation axis direction of the sheet member is greater than in a region other than the end regions.

5. The developing device according to claim 1, wherein the sheet member is a member mainly composed of urethane.

6. The developing device according to claim 1, further comprising a rotation control portion configured to rotate the developer carrying body in the first rotation direction during execution of a development process, and rotate the developer carrying body in the second rotation direction at a predetermined timing excluding a period during which the development process is executed.

7. The developing device according to claim 1, further comprising the toner carrying body configured to feed the toner to a photosensitive body that allows an electrostatic latent image to be formed on a surface thereof, thereby developing the electrostatic latent image.

8. The developing device according to claim 1, wherein the toner carrying body is a photosensitive body that allows an electrostatic latent image to be formed on a surface thereof, and the developer carrying body feeds the toner to the photosensitive body in the first region, thereby developing the electrostatic latent image into a toner image.

9. An image forming apparatus comprising:

a photosensitive body that allows an electrostatic latent image to be formed on a surface thereof, and the developing device according to claim 1, configured to feed the toner to the photosensitive body, thereby developing the electrostatic latent image into a toner image.

* * * * *